US006155518A

United States Patent [19]

Bannenberg

[11] Patent Number: 6,155,518

[45] Date of Patent: Dec. 5, 2000

[54] BLOW BOX FOR LEVITATED GUIDANCE OF A MATERIAL WEB

[75] Inventor: Udo Bannenberg, Bochum, Germany

[73] Assignee: Langbein & Engelbracht GmbH, Bochum, Germany

[21] Appl. No.: 09/305,761

[22] Filed: May 5, 1999

[30] Foreign Application Priority Data

May 14, 1998 [DE] Germany ..... 198 21 542

[51] Int. Cl.[7] ..... B65H 23/24

[52] U.S. Cl. ..... 242/615.11; 226/97.3; 34/633; 34/636

[58] Field of Search ..... 242/615.11, 615.12, 242/548.4, 566; 226/97.3, 97; 34/633, 636

[56] References Cited

U.S. PATENT DOCUMENTS

| | | | |
|---|---|---|---|
| 3,622,058 | 11/1971 | Vits | 226/97.3 |
| 3,807,056 | 4/1974 | Norfolk | 226/97 |
| 4,058,244 | 11/1977 | Vits | 34/640 |
| 4,265,384 | 5/1981 | Daane | 226/97 |
| 4,472,888 | 9/1984 | Spiller | 226/97 |
| 4,785,986 | 11/1988 | Daane et al. | 226/97 |
| 5,125,170 | 6/1992 | Krimsky et al. | 226/97 |
| 5,395,029 | 3/1995 | Kurie | 226/97 |
| 5,792,318 | 8/1998 | Mancini | 226/97.3 |
| 6,049,995 | 4/2000 | Rogne et al. | 34/633 |

FOREIGN PATENT DOCUMENTS 20 08 804 B2 12/1970 Germany .

*Primary Examiner*—Katherine A. Matecki
*Attorney, Agent, or Firm*—Henry M. Feiereisen

[57] ABSTRACT

Apparatus for levitated guidance of a material web moving in a travel direction, includes a blow box which defines an air chamber in communication with a source for supply of blowing air. The blow box has a planar surface portion positioned in facing relationship to the material web and formed vith at least one row of nozzles. Side walls converge from the curved edge zones of the surface portion and diverge toward the material web, to thereby demarcate a pressure conversion compartment of trapezoidal cross section. Arranged adjacent the side walls are diffusion channels which are directly connected with the air chamber of the blow box. The side walls are formed with passageways for fluidly connecting the pressure conversion compartment with the diffusion channels, thereby generating linear jet streams which exit through slots extending transversely to the travel direction of the material web and defined by the side walls and by boundary walls of the diffusion channels in facing relationship to the material web. The row of nozzles is positioned at a central location between the slots and has an opening cross section which is greater than a total opening cross section of all passageways in the side walls. Thus, blowing air issuing out through the nozzles have only a slight dynamic portion so that the material web is guided on an air cushion at constant distance to the surface portion and dried.

17 Claims, 1 Drawing Sheet

BLOW BOX FOR LEVITATED GUIDANCE OF A MATERIAL WEB

CROSS-REFERENCES TO RELATED APPLICATIONS

This application claims the priority of German Patent Application, Serial No. 198 21 542.8, filed May 14, 1998, the subject matter of which is incorporated herein by reference.

BACKGROUND OF THE INVENTION

The present invention relates, in general, to an apparatus for levitated guidance of a material web in a travel direction, and in particular to a blow box of a type having a planar surface portion positioned in facing relationship to the material web, and two slots positioned in space-apart relationship laterally next to curved edge zones of the surface portion and extending transversely to the travel direction, with the surface portion being formed at a central location between the slots with at least one row of orifice openings or nozzles in communication with a fluid chamber which is connected to a source for supply of fluid, e.g., air.

German patent specification DE 20 08 804 describes a blow box of this type. The surface portion is formed with one or more rows of nozzles and is connected via the curved edge zones to side walls which are parallel to one another and extend into the air chamber. The side walls terminate in end portions which are bent by 90° with respect to the side walls and extend parallel to the surface portion, with the end portions terminating in longitudinal edges which form in conjunction with the surface portion the slots. Linear jet streams exit the slots in a converging fashion in the direction to the material web.

As the slots as well as the nozzles in the surface portion are connected directly to the air chamber that is in communication with the air source, blowing air is discharged through the slots and the nozzles at a same velocity. Moreover, a pronounced, wavy pressure curve is established between the material web and the blow box, so that the demand for blowing air is comparably high. As a consequence, the units for supply of blowing air must be accordingly dimensioned. This conventional blow box suffers the further drawback that the converging jet streams exiting the slots contribute only slightly to the drying effect of the material web in the area between these jet streams. The drying action is predominantly realized by the marginal layers of the jet streams which support the material web in, or in opposition to, the travel direction of the material web.

Converging jet streams generate a great pressure area when the material web is at comparably slight distance from the surface portion. However, an increasing distance of the material web to the surface portion results in a decrease of the pressure area until the jet streams intersect at which point the pressure approaches zero. Thus, the capability of the jets to carry or support the material web deteriorates. Although, an increase of the dynamic pressure of the blowing air could conceivably prevent a contact between the material web and the surface portion of the blow box; However, such a measure is accompanied by the drawback that an even greater amount of air is required, without positively affecting the actual drying action.

In view of the unsteady carrying behavior as displayed by the converging jets exiting the slots, there is a risk that the marginal areas of the material web begin to flutter because the blowing air flows off laterally so that the dynamic pressure of the blowing air is reduced. Thus, the marginal areas of the material web are poorly dried, and, moreover, there is a risk that the material web may touch the surface portion of the blow box.

SUMMARY OF THE INVENTION

It is thus an object of the present invention to provide an improved blow box, obviating the afore-stated drawbacks.

In particular, it is an object of the present invention to provide an improved blow box which operates at comparably less blowing air while yet realizing an unobjectionable carrying behavior of the material web and an intense drying action.

These objects, and others which will become apparent hereinafter, are attained in accordance with the present invention by a blow box which has a planar surface portion positioned in facing relationship to the material web and formed with at least one row of nozzles, side walls converging from the curved edge zones of the surface portion and diverging toward the material web, with the surface portion and the side walls defining a pressure conversion compartment of trapezoidal cross section, and diffusion channels positioned adjacent the side walls and directly connected with the air chamber of the blow box, wherein the side walls are formed with passageways for fluidly connecting the pressure conversion compartment with the diffusion channels, thereby generating linear jet streams exiting through slots which extend transversely to the travel direction of the material web and are defined by the side walls and by boundary walls of the diffusion channels in facing relationship to the material web, and wherein the row of nozzles is positioned at a central location between the slots and has an opening cross section which is greater than a total opening cross section of all passageways in the side walls.

An important aspect of the present invention is the fact that the linear jet streams exit the slots in a diverging fashion so that the jet streams are discharged in the direction toward the vertical longitudinal center plane of the blow box as well as in particular in the directions away from the longitudinal center plane to impinge on the material web. While, the jet streams issuing out away from the longitudinal center plane thus assume a major part of the drying action, the jet streams flowing toward the longitudinal center plane also contribute to the drying action.

The diverging escape of the jet streams results in a greater support area when the distance between the material web and the surface portion increases. Further, the diverging jet streams ensure an improved carrying behavior in the marginal zones, thereby substantially eliminating a fluttering in the marginal zones of the material web.

In accordance with another aspect of the present invention, the nozzles in the surface portion are not directly connected to the air chamber; Rather, the blowing air is diverted initially into the lateral diffusion channels and then deflected via passageways in the side walls into the pressure conversion compartment and ultimately to the nozzles. Suitably, the opening cross section of all nozzles in the surface portion is so dimensioned as to exceed the total opening cross section of all passageways in the side walls. This configuration realizes that the comparably high dynamic pressure of the blowing air in the air chamber and also in the diffusion channels is converted in the pressure conversion compartment into a static pressure, so that blowing air exits the nozzles at slight dynamic pressure. As a result, an air cushion is created by air between jet streams exiting the nozzles so that the material web is guided and conveyed between the jet streams in approximately a single plane. Compared to conventional blow boxes, the blowing air escapes the nozzles at a significantly lower velocity. An even pressure curve is realized as a result of a reduced amount of air at the slots and a significantly smaller impulse of blowing air discharged from the nozzles. The drying action is significantly improved and a better carrying behavior is established, thereby eliminating the undesired fluttering, in particular at the margins of the material web.

According to another feature of the present invention, the cross section of the nozzles is so dimensioned with respect to the cross section of the passageways that the velocity of blowing air exiting the nozzles relates to the velocity of air entering from the diffusion channels into the pressure conversion compartment at a ratio of about 1:17. Thus, also the velocity of blowing air exiting through the slots has a ratio of 17:1 to the velocity of blowing air exiting the nozzles.

The even impingement of the blowing air upon the material web can further be enhanced when the jet streams exit the slots at an angle from 5° to 15°, preferably 8°, with respect to the common vertical longitudinal center plane of the pressure conversion compartment and air chamber. In this manner, a greater component of outgoing jet streams is generated in a direction away from the longitudinal center axis, and a smaller component is generated in a direction toward the longitudinal center axis.

According to another feature of the present invention, the surface portion has two rows of circular nozzles in side-by-side disposition, with the nozzles of one of the rows being arranged in the longitudinal direction in a staggered, in particular centric, relationship to the nozzles of the other one of the rows. In this manner, the aeration of the region between the surface portion, the material web and the jet streams exiting the slots is improved as far as the formation of an air cushion is concerned. In addition, the carrying capability of the material web by the blowing air issuing out of the nozzles as well as the drying action are improved. The air cushion is formed between the jet streams exiting the slots and assists to the stabilization of the material web as well as to the drying action.

The direct connection between the air chamber and the diffusion channels positioned laterally of the pressure conversion compartment may be configured in any suitable fashion. A suitable example includes the provision of an intermediate bottom for separating the air chamber from the pressure conversion compartment, with the intermediate bottom having perforations for realizing the direct connection between the diffusion channels and the air chamber. These perforations can easily be punched out. In addition, the intermediate bottom is not only useable to separate the pressure conversion compartment from the air chamber, but enables also a securement of the side walls of the pressure conversion compartment, for example, by welding the free ends of the side walls, converging to the air chamber, to the intermediate bottom. In this manner, the configuration of the blow box is further simplified.

According to another feature of the present invention, the side walls are formed with a greater number of passageways in proximity of their axial ends than in the zone between the ends. In this manner, the carrying behavior is enhanced, and a compensation of blowing air discharged laterally between the surface portion and the material web is realized so as to prevent a fluttering of the material web along the margins.

According to still another feature of the present invention, each side wall is formed with two passageways in side-by-side disposition in proximity of their axial ends, with the two passageways of one side wall confronting the two passageways of the other side wall, wherein each side wall has in an area between the ends passageways which are spaced from one another at a greater distance than the two passageways near the ends of the side walls. The spaced-apart arrangement of the passageways in the zone between the axial ends of the side walls allows blowing air, which enters the pressure conversion compartment in the central region of the blow box, to directly flow upwards to the nozzles, without lateral deflection.

A further stabilization of jet streams issuing out of the nozzles is realized when the diffusion channels are bounded by outer walls and boundary walls which descend toward the outer walls and have terminal edges for demarcating the slots, whereby the terminal edges being arranged offset to the surface portion in direction toward the intermediate bottom.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
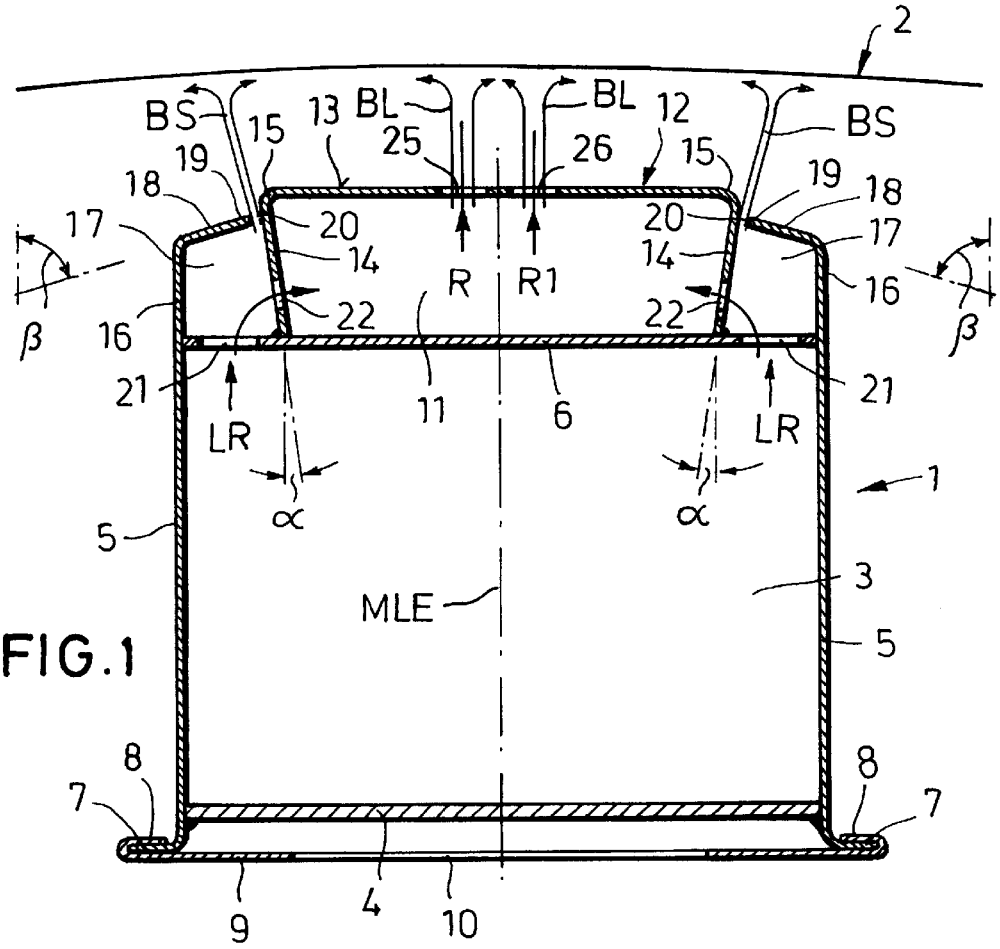
FIG. 1 is a vertical cross section of one embodiment of a blow box according to the present invention, arranged underneath a material web to be guided.

Throughout all the Figures, same or corresponding elements are generally indicated by same reference numerals.

Turning now to the drawing, and in particular to FIG. 1, there is shown a vertical cross section of one embodiment of a blow box according to the present invention, generally designated by reference numeral 1, for levitated guidance of a material web 2 by means of a fluid, e.g., air. For sake of simplicity, the following description relates to the use of air as fluid by way of example only, and it will be understood that the present invention will be likewise applicable to other fluids as well.

The blow box 1 may be part of an arrangement comprised of a set of such blow boxes positioned on one side or on both sides of the material web 2. The blow box 1 has a plenum housing which defines an air chamber 3 of comparably greater dimensions and generally rectangular cross section, with the air chamber 3 being connected to a source (not shown) for supply of air. The air chamber 3 of the plenum housing is defined by two side walls 5 which are interconnected and reinforced at their lower end by braces 4, and an intermediate bottom 6 which interconnects the side wall 5 at their top. Suitably, the connection between the intermediate bottom 6 and the braces 4, on the one hand, with the side walls 5, on the other hand is realized by welding.

The side walls 5 have lower ends 7 which are turned by 90° laterally outwards away from one another and enveloped by end portions 8 of a bottom sheet 9, with the end portions 9 being laterally folded in a U-shaped fashion. The bottom sheet 9 is formed with a central opening 10 for supply of blowing air.

Placed centrally on top of the intermediate bottom 6 above the air chamber 3 is a pressure conversion compartment 11 which is of smaller dimensions than the air chamber 3 and is bounded by a folded sheet, generally designated by reference numeral 12. The folded sheet 12 has a planar surface portion 13 in facing relationship to the material web 2 and two side walls 14 which extend to the intermediate bottom 6 at an angle α of 8° with respect to the vertical, with the side walls 14 being welded to the intermediate bottom 6. The junction between the side walls 14 and the surface portion 13 is formed by convexly curved longitudinal edges 15. The air chamber 3 and the pressure conversion compartment 11 define a common vertical longitudinal center plane MLE.

As shown in FIG. 1, the side walls 5 of the air chamber 3 are extended beyond the intermediate bottom 6 to form outer side walls 16 of diffusion channels 17 disposed adjacent the pressure conversion compartment 11. The side walls 16 terminate in end portions 18 which are bent inwardly at an angle β of 75° with respect to the vertical and extend at an incline in the direction of the pressure conversion compartment 11 such that the free terminal edge 19 of the end portions 18 are spaced from the confronting side walls 14 to thereby define slots 20 which extend over the entire length L of the blow box 1, as indicated in FIG. 2.

Figure 2:
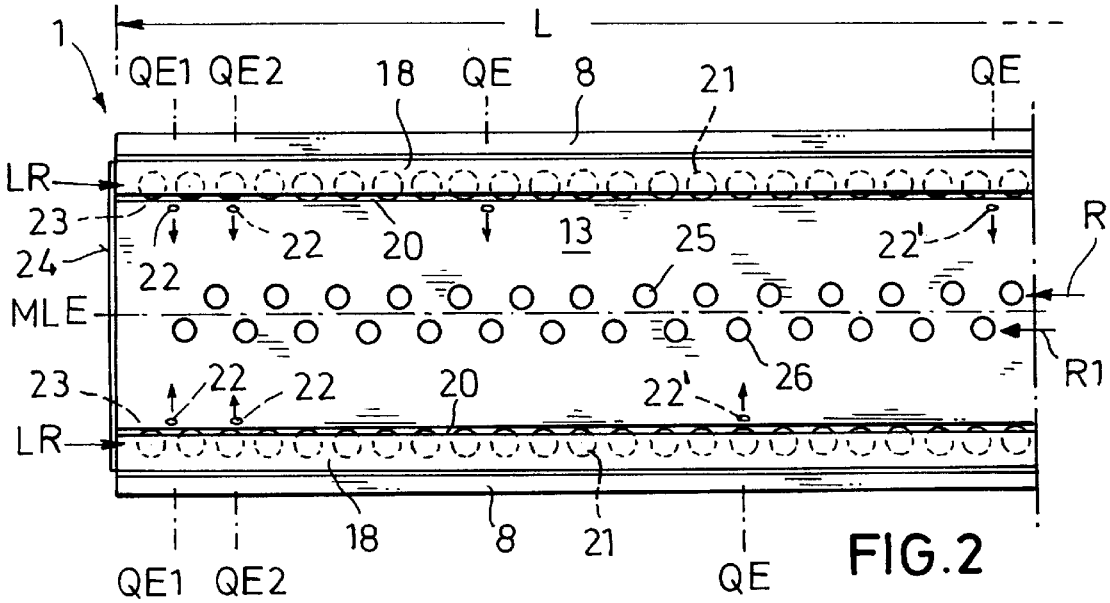
FIG. 2 is a top view, on a smaller scale, of a portion of the blow box of FIG. 1.

As shown in particular in FIG. 2, the diffusion channels 17 are connected to the air chamber 3 via rows LR of holes 21 of circular cross section.

In the lower area of the side walls 14 of the pressure conversion compartment 11 are perforations 22, in particular of circular cross section for realizing a connection between the diffusion channels 16 and the pressure conversion compartment 11. As shown in particular in FIG. 2, the disposition of the perforations 22 is such that near each of the opposite longitudinal ends 23 of each side wall 14, there are provided two perforations 22, with the two perforations 22 of one side wall 14 confronting the two perforations 22 of the other side wall 14. As both ends 23 of the side walls 14 are of an identical construction, it will be understood by persons skilled in the art that a description of one end of the side walls 14 is equally applicable to the other end.

A transverse plane QE1 runs through the two confronting perforations 22 closer to the longitudinal end 23 of the side walls 14, whereby the blow box 1 has an end face 24 which is spaced from the transverse plane QE1 at a distance which is identical to the distance between the transverse plane QE1 and between the transverse plane QE2 which is defined between the other confronting perforations 22 positioned inwardly of the transverse plane QE1.

In addition to the perforations 22 near the longitudinal ends 23, the side walls 14 has also like perforations 22' in the zone between the longitudinal ends 23. These perforations 22' are, however, disposed at a greater spaced-apart relationship compared to the perforations 22 near the longitudinal ends 23. Moreover, the perforations 22' are disposed in the side walls 14 in staggered relationship, with a transverse plane QE being defined by each perforation 22'. The distance between the transverse planes QE of successive perforations 22' of each side wall 14 is approximately eight times the distance between the transverse planes QE1 and QE2 near the ends 23 and defined by the perforations 22.

As further shown in FIGS. 1 and 2, the surface portion 13 of the pressure conversion compartment 11 is formed with two rows R, R1 of orifice openings or nozzles 25, 26 in side-by-side disposition. The nozzles 25, 26 have circular cross section, with the nozzles 25 of the row R being arranged in centrally staggered relationship along the axial length of the blow box 1 with respect to the nozzles 26 of the other row R1. Thus, air supplied from the source into the air chamber 3 streams through the holes 21 into the diffusion channels 17 from where air can enter the pressure conversion compartment 11 via the perforations 22, 22' and be discharged through the nozzles 25, 26 in the direction against the material web 2. At the same time, air is forced through the slots 20 to exit as diverging jet streams BS in the direction against the material web 2.

The total opening cross section of the nozzles 25, 26 is so dimensioned with respect to the total opening cross section of the perforations 22, 22' in the side walls 14, that the velocity of blowing air BL issuing out of the nozzles 25, 26 is seventeen times smaller than the velocity of blowing air BL entering the pressure conversion compartment 11 from the diffusion channels 17 via the perforations 22, 22'. As a consequence of the inclined disposition of the side walls 14, the jet streams BS issue out of the slots 20 in diverging fashion. Thus, a relatively greater component of the jet streams BS is directed against the material web 2 in a direction away from the longitudinal center plane MLE while a quantitatively smaller component of the jet streams BS is directed against the material web 2 in the direction of the longitudinal center plane MLE. Blowing air issuing out of the nozzles 25, 26 at a central location between the jet streams BS has only a slight dynamic component as a result of the conversion of the dynamic pressure into a static pressure in the pressure conversion compartment 11 and thus forms an air cushion between the jet streams BS for supporting and drying the material web 2 free of any contact with the surface portion 13.

While the invention has been illustrated and described as embodied in a blow box for levitated guidance of a material web, it is not intended to be limited to the details shown since various modifications and structural changes may be made without departing in any way from the spirit of the present invention.

What is claimed is:

1. Apparatus for levitated guidance of a material web in a travel direction, comprising a blow box defining an air chamber which is in communication with a source for supply of blowing air, said blow box having:

a planar surface portion positioned in facing relationship to the material web and formed with at least one row of nozzles;

side walls converging from curved edge zones of the surface portion and diverging toward the material web;

a pressure conversion compartment having a trapezoidal cross section and demarcated by the surface portion and the side walls; and diffusion channels positioned adjacent the side walls and directly connected with the air chamber, said side walls being formed with passageways for fluidly connecting the pressure conversion compartment with the diffusion channels, thereby generating linear jet streams exiting through slots; which extend transversely to the travel direction of the material web and are defined by the side walls and by confronting boundary walls of the diffusion channels in facing relationship to the material web, said row of nozzles being positioned at a central location between the slots and having an opening cross section which is greater than a total opening cross section of all passageways in the side walls.

2. The apparatus of claim 1 wherein the pressure conversion compartment and the air chamber define a common vertical longitudinal center plane, said jet streams exiting through the slots at an angle of 5° to 15° with respect to the center plane as a consequence of the converging side walls.

3. The apparatus of claim 1 wherein the jet streams exit through the slots at an angle of 8° with respect to the center plane as a consequence of the converging side walls.

4. The apparatus of claim 1 wherein the surface portion has two rows of circular nozzles in side-by-side disposition, with the nozzles of one of the rows being arranged in the longitudinal direction in a staggered relationship to the nozzles of the other one of the rows.

5. The apparatus of claim 1, and further comprising an intermediate bottom separating the air chamber from the pressure conversion compartment, said intermediate bottom having holes for realizing the direct connection between the diffusion channels and the air chamber.

6. The apparatus of claim 5 wherein the diffusion channels are bounded by outer walls and boundary walls which descend toward the outer walls and have terminal edges for demarcating the slots, said terminal edges being arranged offset to the surface portion in direction toward the intermediate bottom.

7. The apparatus of claim 1, wherein the side walls have opposite ends, said side walls being formed with such passageways at a greater number in proximity of the ends than in an area between the ends.

8. The apparatus of claim 1 wherein the side walls have opposite ends, each said side wall being formed with two such passageways in side-by-side disposition in proximity of the ends, with the two passageways of one side wall confronting the two passageways of the other side wall, said side walls further formed with such passageways in an area between the ends with the further passageways being spaced from one another at a greater distance than the two passageways near the ends of the side walls.

9. A blow box for levitated guidance of a material web in a travel direction, comprising:

a fluid chamber defined by a center plane and connected to a source for supply of a fluid;

a pressure conversion compartment positioned atop of and separated from the air chamber, said pressure conversion compartment being so configured as to convert a dynamic pressure of the fluid into a static pressure;

diffusion channels disposed on opposite sides of the pressure conversion compartment;

first passageways for connecting the fluid chamber with the diffusion channels;

second passageways for connecting the pressure conversion compartment with the diffusion channels;

third passageways defined between the diffusion channels and the pressure conversion compartment for discharge of jet streams of fluid in a substantially diverging fashion, thereby defining one component of jet streams directed away from the center plane against the material web and another component directed toward the center plane against the material web; and fourth passageways for discharge of fluid from the pressure conversion compartment against the material web in an area between the jet streams to thereby form a cushion for support of the material web.

10. The blow box of claim 9 wherein the fourth passageways have an opening cross section which is greater than a total opening cross section of the second passageways.

11. The blow box of claim 9 wherein the jet streams issue out at an angle of 5° to 15° with respect to the center plane.

12. The blow box of claim 11 wherein the jet streams issue out at an angle of 8° with respect to the center plane.

13. The blow box of claim 9 wherein the pressure conversion compartment is bounded by a surface portion in facing relationship to the material web, said fourth passageways being formed by two rows of circular nozzles arranged in side-by-side disposition in the surface portion, with the nozzles of one of the rows being arranged in the longitudinal direction in a staggered relationship to the nozzles of the other one of the rows.

14. The blow box of claim 9 wherein the first passageways are formed by holes provided in an intermediate bottom which separates the fluid chamber from the pressure conversion compartment.

15. The blow box of claim 14 wherein the diffusion channels are bounded by outer walls and boundary walls which descend toward the outer walls and have terminal edges for demarcating the slots, said terminal edges being arranged offset to a material web facing surface portion of the pressure conversion compartment in direction toward the intermediate bottom.

16. The blow box of claim 9 wherein the pressure conversion compartment has side walls having axial ends, said second passageways being provided in the side walls at a greater number in proximity of the axis ends than in an area between the axial ends.

17. The blow box of claim 16 wherein neighboring passageways in the area between the axial ends are spaced from one another at a greater distance than neighboring passageways near the axial ends of the side walls.

* * * * *